US008074716B2

(12) United States Patent
Melder et al.

(10) Patent No.: US 8,074,716 B2
(45) Date of Patent: Dec. 13, 2011

(54) TENSION-ACTIVATED FLUID BYPASS DEVICE AND ASSOCIATED METHOD

(75) Inventors: Jace E. Melder, Erath, LA (US); Johnny N. Champagne, St. Martinville, LA (US); David W. Coleman, Broussard, LA (US)

(73) Assignee: Baker Hughes Incorporated, Houston, TX (US)

( * ) Notice: Subject to any disclaimer, the term of this patent is extended or adjusted under 35 U.S.C. 154(b) by 294 days.

(21) Appl. No.: 12/503,931

(22) Filed: Jul. 16, 2009

(65) Prior Publication Data

US 2011/0011588 A1 Jan. 20, 2011

(51) Int. Cl.
*E21B 31/107* (2006.01)
*E21B 31/113* (2006.01)
*E21B 34/06* (2006.01)

(52) U.S. Cl. ..... 166/301; 166/178; 166/373; 166/386; 166/334.1; 294/86.15

(58) Field of Classification Search ..... 166/301, 166/381, 178, 98, 373, 386, 332.1, 334.1; 294/86.15; 251/353, 354
See application file for complete search history.

(56) References Cited

U.S. PATENT DOCUMENTS

| | | | | |
|---|---|---|---|---|
| 2,732,901 | A * | 1/1956 | Davis | 166/98 |
| 3,735,827 | A * | 5/1973 | Berryman | 175/296 |
| 3,765,487 | A * | 10/1973 | McEver | 166/301 |
| 3,800,876 | A * | 4/1974 | Eggleston | 166/301 |
| 5,170,845 | A * | 12/1992 | Gay et al. | 166/374 |
| 7,281,575 | B2 * | 10/2007 | McElroy et al. | 166/178 |

* cited by examiner

*Primary Examiner* — William P Neuder
*Assistant Examiner* — Catherine Loikith
(74) *Attorney, Agent, or Firm* — Shawn Hunter

(57) ABSTRACT

A fluid bypass tool that can be incorporated into a fishing arrangement between a fluid-operated latching tool and a fluid-operated jarring tool. The latching tool is actuated with fluid from the surface to be latched to and unlatched from a stuck tool in the wellbore. The bypass tool permits fluid flow to the latching tool to be interrupted so that the jarring tool may be operated without risk of inadvertently causing the latching tool to unlatch from the stuck tool.

16 Claims, 5 Drawing Sheets

TENSION-ACTIVATED FLUID BYPASS DEVICE AND ASSOCIATED METHOD

BACKGROUND OF THE INVENTION

1. Field of the Invention

The present invention generally relates to fluid bypass devices used with fishing arrangements within a wellbore and the like.

2. Description of the Related Art

Fishing arrangements are used to try to remove stuck tools or devices from the interior of a wellbore. The stuck tool typically has an upper end fishing neck that can be engaged by a latching tool on a running string. Two common latching tools are known as a spear and an overshot tool. Often, the latching tool is actuated using hydraulic pressure to be latched and unlatched from the fishing neck. In such a case, unobstructed fluid flow from the surface is needed to operate the latching tool, since the latching tool is unlatched from the fishing neck by pumping of a predetermined rate of fluid through the latching tool.

The inventors have recognized that fluid flow through the running string to operate other tools within the running string can inadvertently cause the latching tool to be released from the fishing neck of the stuck tool, which is undesirable.

SUMMARY OF THE INVENTION

The present invention provides a fluid bypass tool that can be incorporated into a fishing arrangement between a fluid-operated latching tool and a fluid-operated jarring tool. The latching tool uses fluid pumped from the surface to become latched to and unlatched from a stuck tool in the wellbore. The bypass tool permits fluid flow to the latching tool to be interrupted so that the jarring tool may be operated without risk of inadvertently causing the latching tool to unlatch from the stuck tool. When fluid flow to the latching tool is interrupted by the bypass tool, fluid flow from the surface may be used to operate the jarring tool.

An exemplary bypass tool is described which includes a tool body that is made up of first and second body sections that are axially moveable with respect to each other. The bypass tool sections are moveable between a first, run-in condition or position, wherein fluid can be flowed from one axial end of the tool to the other axial end, and a second, actuated condition or position, wherein fluid flow into the first axial end of the tool is diverted radially outwardly through the body of the tool. When tension is applied to the bypass tool, lateral fluid flow ports are unblocked which divert fluid flow into the surrounding wellbore, thereby bypassing the latching tool. The body sections are spring-biased toward the first, run-in condition but activated by tension on the running string to move to the activated condition.

BRIEF DESCRIPTION OF THE DRAWINGS

The advantages and other aspects of the invention will be readily appreciated by those of skill in the art and better understood with further reference to the accompanying drawings in which like reference characters designate like or similar elements throughout the several figures of the drawings and wherein.

DETAILED DESCRIPTION OF THE PREFERRED EMBODIMENTS

Figure 1:
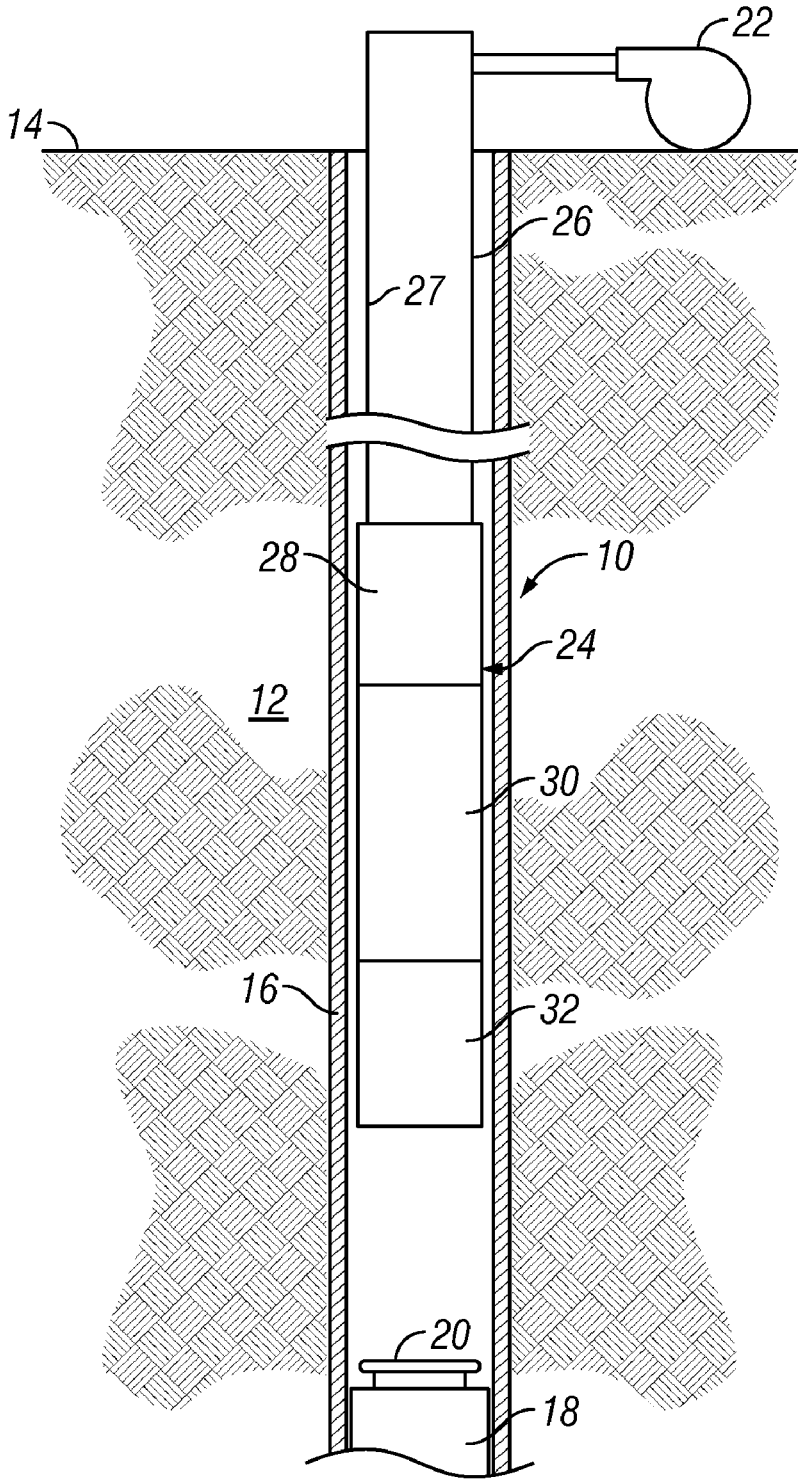
FIG. 1 is a side, cross-sectional view of an exemplary wellbore containing a running string with a latching tool, an impacting tool and a bypass tool constructed in accordance with the present invention.

FIG. 1 illustrates an exemplary subterranean hydrocarbon production wellbore 10 that has drilled through the earth 12 from the surface 14 and lined with casing 16. A stuck tool 18 is shown disposed within the casing 16, and presents a fishing neck 20 by which the tool 18 can be engaged by a fishing arrangement. At the surface 14 of the wellbore 10 is a fluid pump 22 that is operable to flow fluid downwardly through a fishing arrangement.

A fishing arrangement, generally indicated at 24, is disposed within the wellbore 10 above the stuck tool 18. The fishing arrangement 24 includes a running string 26 that extends downwardly from the surface 14 of the wellbore 10. The running string 26 is preferably formed of sections of interconnected tubing of a type known in the art. However, it is also contemplated that coiled tubing can be used. A central fluid flowbore 27 is defined within the running string 26. A fluid-operated impact-type jarring tool 28 is affixed to the lower end of the running string 26. One suitable fluid-operated jarring tool which is suitable for use as the jarring tool 28 is the MG3 jarring tool which is available commercially from Baker Hughes Incorporated of Houston, Tex. Other suitable jarring tools are commercially available as well from other manufacturers/vendors and which are typically referred to as "impact hammers" or "impact jars." The term "fluid-operated" when used with respect to the jarring tool 28 is intended to mean that the jarring tool 28 is actuated by a flow of fluid through the tool 28 from the surface-based fluid pump 22.

A fluid bypass tool 30, in accordance with the present invention, is operably connected with the lower end of the jarring tool 28. It is noted that, while FIG. 1 shows the fluid bypass tool 30 to be directly affixed to the jarring tool 28, the two components may be operably connected to each other via one or more intermediate tools or tubing string sections. An overshot latching tool 32 is operably connected with the lower end of the fluid bypass tool 30. Again, although these two components are shown directly interconnected, there may be intermediate components. The overshot latching tool 32 is designed to engage the fishing neck 20 of the stuck tool 18 in order to attempt to retrieve it from the wellbore 10. The latching tool 32 is also fluid-operated in that the latching and/or unlatching of the tool 32 from the fishing neck 20 requires or uses, at least in part a flow of fluid downwardly through the fishing arrangement 24 from the surface-based fluid pump 22 through the latching tool 32. Typically, these tools have a flow release feature that allows release of the tool 32 from the stuck object 18 by pumping a predetermined flow rate which will move a collet or slip into a release position. If the fish, or stuck object, 18 is unable to pull free, one can release the latching tool 32 from the stuck object 18 by setting weight down and pumping fluid through the latching tool 32 to release it from the stuck object 18 and thereafter returning the released fishing arrangement 24 to the surface 14.

Figure 2:
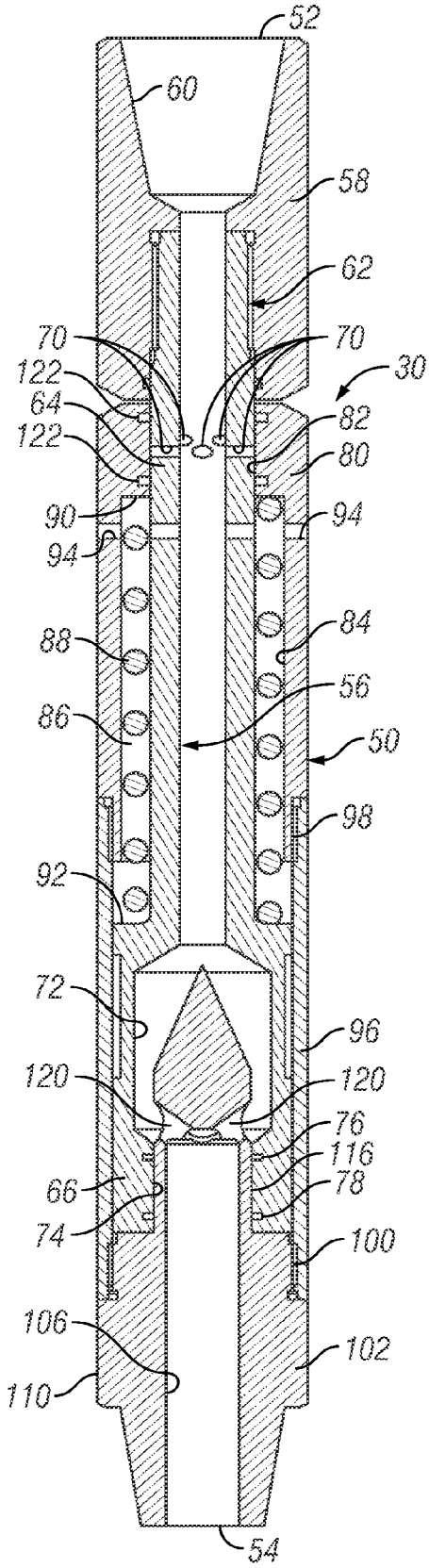
FIG. 2 is a side, cross-sectional view of an exemplary bypass tool, constructed in accordance with the present invention, in a run-in condition.
Figure 3:
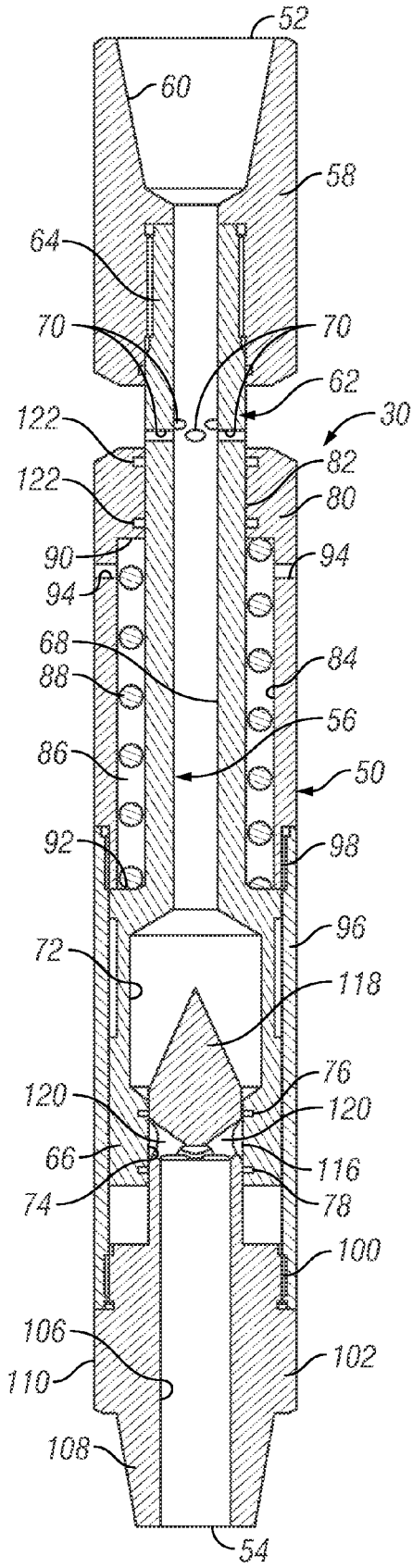
FIG. 3 is a side, cross-sectional view of the bypass tool shown in FIG. 2, now in an actuated condition.

FIGS. 2-3 illustrate an exemplary fluid bypass tool 30 constructed in accordance with the present invention in greater detail. The bypass tool 30 includes a tool body 50 having an upper axial end 52 and a lower axial end 54. A central flowbore 56 is defined along the axial length of the tool body 50. The upper end 52 of the tool body 50 is provided by an upper sub 58. The upper sub 58 provides a box-type threaded portion 60 to permit the upper sub 58 to be affixed to the jarring tool 28. The upper sub 58 is threadedly affixed to a mandrel 62. The mandrel 62 includes a reduced diameter shaft 64 and an enlarged-diameter chamber housing 66. A flowbore portion 68 is defined generally within the shaft 64. Inner lateral fluid flow ports 70 are disposed through the shaft 64 to permit fluid communication between the flowbore portion 68 and the area radially surrounding the shaft 64. The chamber housing 66 of the mandrel 62 defines an enlarged-diameter fluid chamber 72 which is in fluid communication with the flowbore portion 68. The fluid chamber 72 adjoins a reduced diameter neck 74. Annular fluid seals 76 and 78 are disposed within the neck 74.

A retainer 80 radially surrounds the shaft 64 of the mandrel 62. The retainer has a reduced diameter inner surface 82 and an enlarged diameter inner surface 84. When the retainer 80 surrounds the shaft 64, a spring chamber 86 is defined therebetween. Compression spring 88 is retained within the spring chamber 86. The upper end of the compression spring 88 abuts a downward-facing shoulder 90 on the retainer 80 while the lower end of the compression spring 88 abuts an upward-facing shoulder 92 on the chamber housing 66. A set of lateral fluid equalization ports 94 are disposed through the retainer 80 to permit surrounding well fluids to flow into and out of the spring chamber 86.

Figure 4:
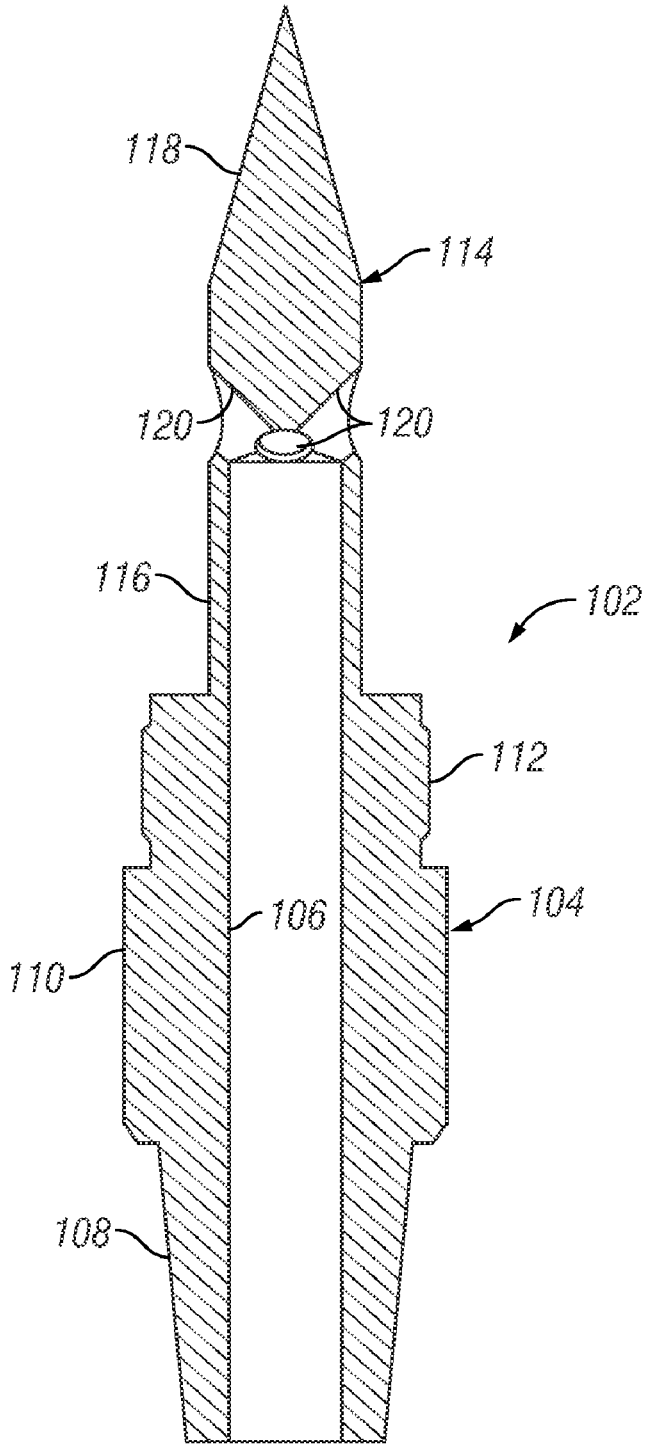
FIG. 4 is side, cross-sectional view of a bottom sub used within the bypass tool shown in FIGS. 2 and 3.
Figure 5:
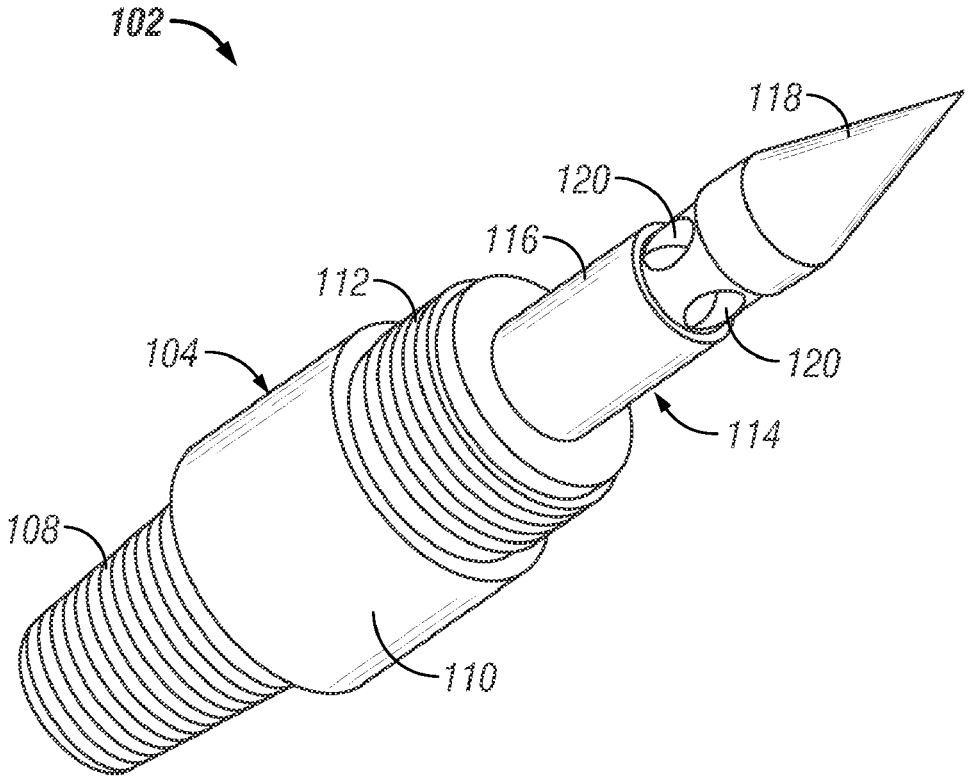
FIG. 5 is an isometric view of the bottom sub shown in FIG. 4.

A tubular sleeve 96 is affixed by a first threaded connection 98 to the retainer 80. The sleeve 96 is also affixed by a second threaded connection 100 to a bottom sub 102. The bottom sub 102 is shown in greater detail in FIGS. 4 and 5. The bottom sub 102 features a sub body 104 which defines a central bore 106. The lower end of the sub body 104 presents a threaded pin-type connection 108 which permits the fluid bypass tool 30 to be interconnected to the latching tool 32. The sub body 104 also includes an enlarged central portion 110 with an external threaded portion 112 by which the bottom sub 102 can be affixed to the sleeve 96. A fluid deflector portion 114 extends axially from the central portion 110 and includes a cylindrical outer radial surface 116 and a distal conical fluid deflector surface 118. One of more angled fluid passages 120 are disposed through the fluid deflector portion 114 and permit fluid to flow into the central bore 106.

FIG. 2 depicts the bypass tool 30 in an initial run in condition wherein the compression spring 88 is substantially uncompressed. The spring 88 biases the retainer 80 upwardly with respect to the internal mandrel 62 until the retainer 80 is in contact with the upper sub 58. In this configuration, the cylindrical outer radial surface 116 of the fluid deflector portion 114 of bottom sub 102 is located within the neck 74 of the mandrel 62. It is also noted that fluid flow through the lateral fluid flow ports 70 of the mandrel shaft 64 is blocked by the retainer 80. Annular fluid seals 122 are located on each axial side of the ports 70 to isolate them. Fluid flowing downwardly through the central flowbore 56 from the direction of the upper end 52 will enter the fluid chamber 72 and be transmitted through the angled fluid passages 120 to the central bore 106 of the bottom sub 102. Therefore, fluid can flow downwardly through the bypass tool 30 to reach and operate the overshot latching tool 32.

The fishing arrangement 24 is run into the wellbore 10 and lowered until the overshot latching tool 32 engages the fishing neck 20 of the stuck tool 18. Once this is done, it is desired to operate the jarring tool 28 to try to remove the stuck tool 18. The inventors have recognized that it is also desirable at this time to cut off fluid flow to the latching tool 32 in order to prevent it from being inadvertently unlatched from the fishing neck 20 by variations in fluid pressure in the flowbore 27 during operation of the jarring tool 28.

An overpull on the running string 26 is used to move the bypass tool 30 from the run in configuration shown in FIG. 2 to the actuated configuration shown in FIG. 3. The force of the overpull must be sufficient to overcome the biasing force of the spring 88 and compress it. As the running string 26 is pulled upwardly, the upper sub 58 and affixed mandrel 62 move axially upwardly with respect to the bottom sub 102, sleeve 96 and retainer 80. The spring 88 is compressed. As this occurs, the neck 74 of the mandrel 62 covers the angled fluid passages 120 of the bottom sub 102, thereby blocking fluid flow through them and into the central bore 106. Fluid seals 76, 78 help to isolate the passages 120. At the same time, the retainer 80 is moved downwardly upon the mandrel shaft 64 so that the lateral flow ports 70 are unblocked. As a result, fluid flowing through the central flowbore 56 will be expelled into the wellbore 10. However, fluid flowing through the jarring tool 28 and into the bypass tool 30 will still operate the jarring tool 28.

It will be understood that the upper sub 58 and mandrel 62 collectively form a first tool section, while the bottom sub 102, sleeve 96 and retainer 80 collectively form a second tool section. The first and second tool sections are axially moveable with respect to each other between the first, run-in condition and the second, actuated condition.

When the stuck tool 18 has been unstuck from the wellbore 10 via operation of the jarring tool 28, axial tension upon the bypass tool 30 will be reduced, and the spring 88 will urge the bypass tool back to the run-in configuration.

It should be understood that the invention also provides a method for selectively diverting fluid flow from the fluid-operated latching tool 32 while permitting the fluid-operated jarring tool 28 to be operated by fluid flowed through the running string 26.

Further, the invention provides a method and system for removing a stuck tool or object 18 from within a wellbore 10. In an exemplary method for removing a stuck tool or object 18, a fishing arrangement 24 is disposed into the wellbore 10 having a fluid-operated jarring tool 28, a fluid-operated latching tool 32 and a fluid bypass tool 30 disposed between the jarring tool 28 and the latching tool 32. The latching tool 32 is latched to the stuck tool or object 18 using fluid flow through the fishing arrangement 24 to accomplish the latching. Thereafter, the bypass tool 30 is actuated to divert the fluid flow from entering the latching tool 32. Fluid flow through the fishing arrangement 24 then actuates the jarring tool 28 to remove the stuck tool or object 18.

Those of skill in the art will recognize that numerous modifications and changes may be made to the exemplary designs and embodiments described herein and that the invention is limited only by the claims that follow and any equivalents thereof.

What is claimed is:

1. A fluid bypass tool to be incorporated into a wellbore fishing arrangement having a fluid-operated jarring tool and a fluid-operated latching tool, the fluid bypass tool comprising:

a first tool section that is operably connected with the jarring tool;

a second tool section that is operably connected with the latching tool; and the first and second tool sections being selectively moveable with respect to each other between a first condition, wherein an operating fluid flow through the fishing arrangement to the latching tool is permitted, and a second condition, wherein the operating fluid flow to the latching tool is blocked.

2. The fluid bypass tool of claim 1 wherein the first and second tool sections are moved from the first condition to the second condition by applying tension upon the first and second tool sections.

3. The fluid bypass tool of claim 1 wherein the first and second tool sections are spring-biased toward the first condition.

4. The fluid bypass tool of claim 1 wherein a central axial flowbore is defined within the first and second tool sections to permit fluid to flow axially through the bypass tool.

5. The fluid bypass tool of claim 1 wherein, in the second condition, fluid flow through the fishing arrangement is expelled radially outwardly into a surrounding wellbore.

6. A fluid bypass tool to be incorporated into a wellbore fishing arrangement having a fluid-operated jarring tool and a fluid-operated latching tool, the fluid bypass tool comprising:

a first tool section that is operably connected with the jarring tool;

a second tool section that is operably connected with the latching tool;

the first and second tool sections being selectively moveable with respect to each other between a first position, wherein an operating fluid flow through the fishing arrangement to the latching tool is permitted, and a second position, wherein the operating fluid flow to the latching tool is blocked; and wherein the first and second tool sections are moved from the first condition to the second condition by applying tension upon the first and second tool sections.

7. The fluid bypass tool of claim 6 wherein the first and second tool sections are spring biased toward the first condition.

8. The fluid bypass tool of claim 6 wherein a central axial flowbore is defined within the first and second tool sections to permit fluid to flow axially through the bypass tool.

9. The fluid bypass tool of claim 6 wherein, in the second condition, fluid flow through the fishing arrangement is expelled radially outwardly into a surrounding wellbore.

10. A fishing arrangement for removing a stuck object from a wellbore, the fishing arrangement comprising:

a fluid-operated jarring tool;

a fluid-operated latching tool; and a fluid bypass tool comprising:

a) a first tool section that is operably connected with the jarring tool;

b) a second tool section that is operably connected with the latching tool; the first and second tool sections being selectively moveable with respect to each other between a first condition, wherein an operating fluid flow through the fishing arrangement to the latching tool is permitted, and a second condition, wherein the operating fluid flow to the latching tool is blocked.

11. The fishing arrangement of claim 10 wherein the wherein the first and second tool sections are spring-biased toward the first condition.

12. The fishing arrangement of claim 10 wherein a central axial flowbore is defined within the first and second tool sections to permit fluid to flow axially through the bypass tool.

13. The fishing arrangement of claim 10 wherein, in the second condition, fluid flow through the fishing arrangement is expelled radially outwardly into a surrounding wellbore.

14. The fishing arrangement of claim 10 wherein the first and second tool sections are moved from the first condition to the second condition by applying tension upon the first and second tool sections.

15. A method of removing a stuck object from a wellbore with a fishing arrangement comprising the steps of:

disposing a fishing arrangement into the wellbore, the fishing arrangement having a fluid-operated jarring tool, a fluid-operated latching tool, and a fluid bypass tool operably connected with the jarring tool and the latching tool, the fluid bypass tool having:

a) a first tool section that is operably connected with the jarring tool;

b) a second tool section that is operably connected with the latching tool;

c) the first and second tool sections being selectively moveable with respect to each other between a first condition, wherein an operating fluid flow through the fishing arrangement to the latching tool is permitted, and a second condition, wherein the operating fluid flow to the latching tool is blocked;

latching the latching mechanism to the stuck object;

actuating the bypass tool to divert fluid flow from entering the latching tool; and operating the jarring tool to remove the stuck object.

16. The method of claim 15 wherein the step of actuating the bypass tool comprises applying tension to the fishing arrangement to move the bypass tool to the second condition.

* * * * *